US009974366B2

(12) United States Patent
Heim

(10) Patent No.: US 9,974,366 B2
(45) Date of Patent: May 22, 2018

(54) FOLDING POLE HAVING A TUBULAR SLEEVE

(71) Applicant: LEKISPORT AG, Baar (CH)

(72) Inventor: Eberhard Heim, Unterensingen (DE)

(73) Assignee: LEKISPORT AG, Baar (CH)

( * ) Notice: Subject to any disclaimer, the term of this patent is extended or adjusted under 35 U.S.C. 154(b) by 0 days. days.

(21) Appl. No.: 15/302,311

(22) PCT Filed: Mar. 17, 2015

(86) PCT No.: PCT/EP2015/055505
§ 371 (c)(1),
(2) Date: Oct. 6, 2016

(87) PCT Pub. No.: WO2015/154952
PCT Pub. Date: Oct. 15, 2015

(65) Prior Publication Data

US 2017/0027290 A1 Feb. 2, 2017

(30) Foreign Application Priority Data

Apr. 11, 2014 (CH) ..... 0558/14

(51) Int. Cl.
*A45B 9/00* (2006.01)
*A63C 11/22* (2006.01)

(52) U.S. Cl.
CPC ..... *A45B 9/00* (2013.01); *A63C 11/22* (2013.01); *A45B 2009/007* (2013.01);
(Continued)

(58) Field of Classification Search
CPC ..... A45B 9/00; A45B 2009/007; A45B 3/12; A63C 11/22; A63C 2203/10; A63C 11/221
(Continued)

(56) References Cited

U.S. PATENT DOCUMENTS 3,722,903 A * 3/1973 Jones ..... A63C 11/221 16/429
3,730,544 A * 5/1973 Hyman ..... A63C 11/22 135/114
(Continued)

FOREIGN PATENT DOCUMENTS

DE 694 01 765 T2 10/1997
DE 297 06 849 U1 9/1998
(Continued)

OTHER PUBLICATIONS

International Preliminary Report on Patentability with translation of Written Opinion dated Oct. 20, 2016, issued by the International Searching Authority in application No. PCT/EP2015/055505.
(Continued)

*Primary Examiner* — Winnie Yip
(74) *Attorney, Agent, or Firm* — Sughrue Mion, PLLC

(57) ABSTRACT

A pole comprising a pole handle and a pole tip, with at least two tube portions located therebetween, which in an assembled state of the pole are connected to one another by means of insertion connections aligned along a longitudinal pole axis A. At least one of the plug connections is realized on a second tube portion by way of a form-fit and/or force-fit locking device, wherein the second tube portion has a smaller the same outer diameter than the inner diameter of a first tube portion, and which can be inserted into the first tube portion, and which can be fixed in the relative axial position by means of the form-fit locking device. On at least one of the plug connections, a tubular sleeve having a clamping element in a receiving groove is arranged between the tubular sleeve and the lower end of the first tubular portion.

25 Claims, 5 Drawing Sheets

(52) U.S. Cl.
CPC ..... *A45B 2200/055* (2013.01); *A63C 11/221* (2013.01); *A63C 2203/10* (2013.01)

(58) Field of Classification Search
USPC ..... 135/65–66, 74, 75; 280/819, 823
See application file for complete search history.

(56) References Cited

U.S. PATENT DOCUMENTS

| | | | | |
|---|---|---|---|---|
| 3,797,845 | A * | 3/1974 | Kepka | A63C 11/222 280/819 |
| 5,941,435 | A * | 8/1999 | Munro, III | A45F 5/14 224/222 |
| 6,354,629 | B1 * | 3/2002 | McNeal | A63C 11/221 135/75 |
| 6,520,192 | B1 * | 2/2003 | Lo | A45B 19/04 135/114 |
| 6,938,927 | B1 * | 9/2005 | Martin | A45B 7/00 135/69 |
| 7,172,219 | B2 * | 2/2007 | Spragg | A63C 11/221 280/814 |
| 8,950,415 | B1 * | 2/2015 | Spletzer | A61H 3/02 135/74 |
| 2008/0041432 | A1 * | 2/2008 | Willis | A45B 3/12 135/74 |
| 2010/0122718 | A1 * | 5/2010 | Lah | A45B 9/00 135/75 |
| 2010/0200032 | A1 * | 8/2010 | Lee | A45B 9/00 135/74 |
| 2013/0312797 | A1 * | 11/2013 | Lah | A45B 9/00 135/74 |

FOREIGN PATENT DOCUMENTS

| | | | |
|---|---|---|---|
| DE | 297 08 829 | U1 | 9/1998 |
| EP | 0 098 898 | A1 | 1/1984 |
| EP | 1 217 224 | A1 | 6/2002 |
| EP | 1 450 906 | | 9/2004 |
| EP | 1 949 812 | A1 | 7/2008 |
| WO | 03/095041 | A1 | 11/2003 |
| WO | 2010/085905 | A1 | 8/2010 |
| WO | 2012/104424 | A1 | 8/2012 |
| WO | 2013/162180 | A1 | 10/2013 |

OTHER PUBLICATIONS

International Search Report of PCT/EP2015/055505 dated May 29, 2015.

* cited by examiner

FOLDING POLE HAVING A TUBULAR SLEEVE

CROSS REFERENCE TO RELATED APPLICATIONS

This application is a National Stage of International Application No. PCT/EP2015/055505 filed Mar. 17, 2015, claiming priority based on Swiss Patent Application No. 00558/14 filed Apr. 11, 2014, the contents of all of which are incorporated herein by reference in their entirety.

TECHNICAL SCOPE

The present invention relates to a tubular sleeve for a multi-segmented pole, in particular for a telescopic pole or folding pole. In addition, the present invention relates to a sports pole having such a tubular sleeve, e.g. in the area of poles for hiking and Nordic walking, but also in the broadest sense for other types of sport such as, for example, cross-country skiing or alpine skiing, alpinism etc.

PRIOR ART

Pole structures which are length-adjustable are known in particular from the area of hiking or Nordic walking. The adjustability, in this case, can be utilized, on the one hand, so that the length of the pole is able to be adjusted to the requirements, and on the other hand, however, also for the purpose of reducing the pole to as small as possible a pack size, i.e. to develop the length in such a manner so that it can be severely reduced so that the pole is able to be stowed in a rucksack or the like. Such telescopic structures, where so-called inner tubes with a small diameter are stored displaceably in an outer tube with a somewhat larger diameter, and where the relative position of the tubular portions is able to be secured by a locking mechanism, are disclosed, for example, in DE 297 06 849 or, however, also in DE 297 08 829 or EP 1 450 906. When such structures are used, it is imperative that the individual tubular portions have different diameters, and additionally it has to be ensured, so that in particular the small pack size is able to be achieved, that the tubes are also actually able to be nested extensively into one another.

In this case, the wall thickness of the pole, in particular in the bottom region where typically the thinnest tube is arranged, can be very thin, and consequently no longer has adequate inherent rigidity for many applications. In addition, the structures disclosed in said documents are not always optimally suited to all applications and users as the relative position of the individual pole tube portions has to be secured as a result of rotating said pole tube portions with respect to one another, for which purpose corresponding torques that are to be applied manually are necessary.

Alternative mechanisms where the relative securing of the axial position of different tubular portions is not realized by an inside locking mechanism are disclosed, for example, in WO 2010/085905, or, however, also in DE 694 01 765 or EP 1 217 224 or rather EP 0 098 898, said outside structures, however, are frequently not suitable for the purpose of storing more than two pole tubes displaceably in one another, as a result of which the pack size is not sufficiently reduced either.

An improved folding pole is disclosed in WO 2012/104424. With regard to the preferred development of the folding pole per se, reference is made to the disclosure content of said WO 2012/104424.

REPRESENTATION OF THE INVENTION

It is correspondingly, among other things, the object of the present invention to provide a structurally simple and consequently sturdy folding pole which can be folded up in as small a manner as possible, for example in order to be stored in a rucksack or a pocket, wherein at the same time, however, the disadvantages of the folding poles disclosed in the prior art are to be eliminated.

In the case of such a folding pole, as also in the case of other devices with several tubular portions which can be plugged into one another or telescoped into one another, the following problems may arise: On account of the certain play which is necessary so that the two tubular portions can be displaced axially against one another for the purpose of interlocking or being pulled apart, rattling noises can occur in the region of the respective plug connection between the two contacting tubular portions. This is acoustically annoying and can additionally allow the structure to appear loose, which can give the impression that the product used is a low quality or volatile structure. In addition, such repeated placing of the outside surface of the inner tubular portion against the inside surface of the outer tubular portion can lead to friction damage or abrasion and material fatigue.

In particular in the case of poles in the compacted or folded state, the harmful play and the resultant rattling noise which occurs, where applicable, and can result from reciprocal contact between the inner tubular portion and the outer tubular portion is therefore to be avoided in particular according to the following invention. Said object is achieved by a pole with the features of claim 1. In addition, the present invention also results in increased stability, longevity and sturdiness of the pole.

Consequently, the present invention relates to a pole with at least two, preferably at least three or four tubular portions. In the assembled state of the pole, the tubular portions are connected together by means of at least one plug connection aligned along a pole longitudinal axis A, and a pole handle is usually arranged on a topmost tubular portion and a pole tip is arranged on a bottommost tubular portion.

At least one of the plug connections is realized, in this case, as a positive-locking and/or non-positive-locking latching device between a first tubular portion and a second tubular portion. The latching devices, therefore, can be positive-locking mechanisms with so-called push-buttons, i.e. with spring-loaded radial latching pins which are mounted in the inner tube and engage in recesses or holes of the outer tube or of a tubular sleeve fastened thereon or abut against stop edges of said elements. Also possible are positive-locking mechanisms where the inner tube comprises a non-movable stop collar, stop shoulder or stop rib, as is known for simple plug connections. Non-positive-locking inside clamping means are also possible, as disclosed in particular in EP 1 450 906. Combinations of said mechanisms are also possible.

So that the above-specified telescopic feature is provided, the second tubular portion has a smaller or almost identical outside diameter compared to the inside diameter of the first tubular portion and is consequently insertable into the first tubular portion (7).

According to the invention, the tubular portions are able to be fixed in their relative axial position by the latching device, wherein the plug connection includes a tubular sleeve which is fastened so as be non-movable on the first tubular portion, protrudes in a protrusion region by means of the end edge of the first tubular portion facing the second tubular portion, engages under said end edge radially by way of a circumferential flange which is directed to the second tubular portion and surrounds the second tubular portion in the protrusion region.

The structure according to the invention is in particular characterized then in that a typically resilient clamping element is arranged in the protrusion region between a radial inside surface of the tubular sleeve and the radial outside surface of the second tubular portion.

In the case of usual structures, the tubular sleeve directly encompasses the bottom edge of the first tubular portion by way of its flange such that the inside surface of the flange comes to abut against the bottom edge of the tubular portion, and the flange, by way of its bottom surface, then protects the end edge of the first tubular portion for the positive-locking fastening. The corresponding fastening pin (push-button) does not abut against the bottom edge of the first tubular portion and correspondingly can also not damage or break it.

In the case of the structure proposed here, such a tubular sleeve is preferably slid less far, as it were, onto the first tubular portion such that a circumferential groove, into which the named clamping element is able to be placed, is created between the flange and the end edge.

In other words, according to a preferred embodiment there is a circumferential, inwardly open receiving groove in the protrusion region delimited by the end edge, the radial inside surface of the tubular sleeve and the flange, and the clamping element is arranged in said receiving groove. The clamping element, in this case, is preferably dimensioned such that it contacts both the radial inside surface of the tubular sleeve and the radial outside surface of the second tubular portion and clamps said surfaces against one another in a resilient manner. In particular, therefore, the tubular sleeve, on its bottom end which is directed axially toward the pole tip, comprises a radially inwardly directed flange. Said flange, which advantageously connects to a hollow cylindrical portion of the tubular sleeve, encompasses the bottom end of the first tubular portion, or the bottom end of the first tubular portion rests on a shoulder of the flange. The flange can also be obtained by the conical tapering of the tubular sleeve being directed down toward the pole tip.

The clamping element is advantageously arranged in the radial direction between the second tubular portion, or the radial outside surface of the second tubular portion and a radial inside surface of the tubular sleeve. In this case, the clamping element forms a connection between the radial outside surface of the second tubular portion and the radial inside surface of the tubular sleeve, a distance, which is defined by a circumferential space between the radial inside surface of the first tubular portion (outer tubular portion) and the radial outside surface of the second tubular portion (inner tubular portion), preferably being fixed. The clamping element consequently acts to a certain extent as a sealing element or spacer in said cavity between the tubular sleeve and the tubular portions. In this case, the radial position of the two telescoped or overlapping tubular portions is fixed.

The tubular sleeve is connected fixedly to the first tubular portion in a non-positive-locking and/or positive-locking and/or a materially-bonding manner, preferably in a materially-bonding manner, in particular is fixedly connected to the bottom end of the first tubular portion facing the pole tip such that the tube sleeve is arranged so as to be axially non-movable on the first tubular portion.

According to a particularly preferred embodiment of the pole according to the invention, the positive-locking latching device comprises a spring-loaded radial latching pin which is preferably held projecting through a radial through-bore of the second tubular portion against the action of a spring element. The latching device, in this case, preferably also runs through a through-bore, which is in alignment with the through-bore in the second tubular portion, in a fastening portion of a guiding pin which is admitted into and fixed in the second tubular portion, the latter abutting with the axial closure surface of the flange which faces the second tubular portion.

The proposed positive-locking mechanism referred to here can be developed such that the tubular sleeve and/or the outer tube comprise a hole for receiving such a guiding pin, said holes then preferably being arranged in a congruent manner. The lateral surface of the tubular sleeve can be extended somewhat for this purpose. The push-button, which can comprise per se in a preferred manner a lateral surface which is flattened in the abutment region with the bottom edge of the tubular sleeve, can in this case also comprise a round lateral surface. The positive-locking mechanism referred to here is preferably not a mechanism where the tubular sleeve and/or the outer tube comprise a hole for receiving such a guiding pin, but a mechanism where the bottom edge of the tubular sleeve serves as a stop for such a guiding pin. Said bottom edge, however, can comprise a recess or axial indentation which is downwardly open for receiving the guiding pin in order to ensure a more reliable abutment and an anti-rotation means.

The tubular sleeve, according to a further preferred embodiment, is formed substantially from a light metal, preferably from aluminum or an aluminum alloy.

In contrast, the clamping element is resiliently deformable preferably at least in regions.

In this case, the clamping element is preferably formed at least in part from plastics material, in particular in a preferred manner based on a thermoplastic material or a thermoplastic elastomer, in a particularly preferred manner cross-linked or non-cross-linked systems based on polypropylene, polyethylene, polyester, polyamide, copolyamide, olefin-based and/or urethane-based thermoplastic elastomers, thermoplastic polyester elastomers, thermoplastic copolyester or a mixture thereof.

According to a particularly preferred embodiment, the clamping element is realized in a substantially ring-shaped manner, wherein the clamping element completely surrounds the second tubular portion inside the circumferential groove in the circumferential direction, wherein it additionally fills out the axial length of the receiving groove substantially completely preferably at least in regions.

It is particularly advantageous when the clamping element comprises a radially inner portion and a radially outer portion, wherein the radially outer portion preferably fills out the axial length of the receiving groove substantially completely and wherein the radially inner portion fills out the axial length of the cavity only in part. The two portions are preferably connected together on one of the two axial sides such that to a certain extent the radially inner portion forms a circumferential tongue in regions. The clamping element, in this case, is preferably arranged in such a manner in the groove that the tongue is directed to the side remote from the inner tube.

The clamping element is preferably realized in one piece. In this case, the clamping element can be realized per se in a resilient manner, such as, for example, in the case of a sealing ring or O-ring seal. The clamping element can actually be realized as an O-ring seal arranged in the groove.

As an alternative to this, the clamping element can also be realized with multiple parts, wherein only part, preferably only the radially inner portion of the clamping element, can be formed from a resiliently deformable material, or wherein the radially inner portion of the clamping element can be developed from a material with greater resilient deformability than the radial outer portion of the clamping element.

A particularly preferred exemplary embodiment comprises a clamping element which comprises, at least in part of its circumference, in a cross section along the pole longitudinal axis through the clamping element, a substantially hook-shaped or U-shaped profile with a radially inner leg and a radially outer leg of preferably various lengths, and preferably also of various maximum widths measured in the radial direction. In this case, preferably the radially inner leg has a smaller axial length than the radially outer leg and preferably a smaller radially measured maximum width than the radially outer leg. For example, the radially outer leg can have an axial length of within the range of 1-20 mm, preferably of 2-15 or 3-10 mm, and the radially inner leg can have an axial length of within the range of 1-20 mm and preferably of 1-8 or 1.5-5 mm. The radially inner portion of the clamping element, in this case, can be provided in the circumferential direction with a recess which is preferably upwardly open toward the pole handle. In other words, it can be advantageous when the clamping element at its radially inner portion or when the radially inner leg is realized in the circumferential direction so as not to be completely circumferential in the circumferential direction, i.e. with at least one interruption and preferably 2-4 interruptions. Said recesses, which are preferably arranged at regular spacings in the circumferential direction, result in an arrangement of multiple upwardly pointing legs which are preferably spaced apart in a regular manner. The radially inner portion of the clamping element can consequently be realized to a certain extent in a toothed manner.

The radially inner portion of the clamping element resembles to a certain extent a lip which points upward to the pole handle, it being possible for said lip to be continuous in the circumferential direction, i.e. ring-shaped, with or without interruptions.

In order to hold the two tubular portions non-rotatably with respect to one another in the circumferential direction or in order to secure the rotation position of the two tubular portions with respect to one another, it can be particularly advantageous when the spring-loaded radial latching pin is held projecting through a recess of the tubular sleeve which extends in in the circumferential direction and is preferably realized open toward an end of the tubular sleeve facing the pole tip.

According to a particularly preferred embodiment, the pole according to the invention is a folding pole, wherein the tubular portions are connected together by means of at least one tension cable, and wherein preferably at least two tubular portions are connected together in the folded-together state of the folding pole only by means of the tension cable.

In particular, the present invention relates to a tubular sleeve for a folding pole, such as is described in WO 2012/104424. Consequently, the pole according to the invention preferably comprises a folding mechanism or plugging mechanism as described in WO 2012/104424. The use of the tubular sleeve according to the invention, however, is not restricted to such a type of pole but can also be used in other multi-segmented, folding or telescopic poles or tubes.

Further exemplary embodiments are described in the dependent claims.

BRIEF DESCRIPTION OF THE DRAWINGS

Preferred embodiments of the invention are described below by way of the drawings which simply serve for explanation purposes and are not to be seen as restricting. The drawings are as follows.

DESCRIPTION OF PREFERRED EMBODIMENTS

Figure 1A:
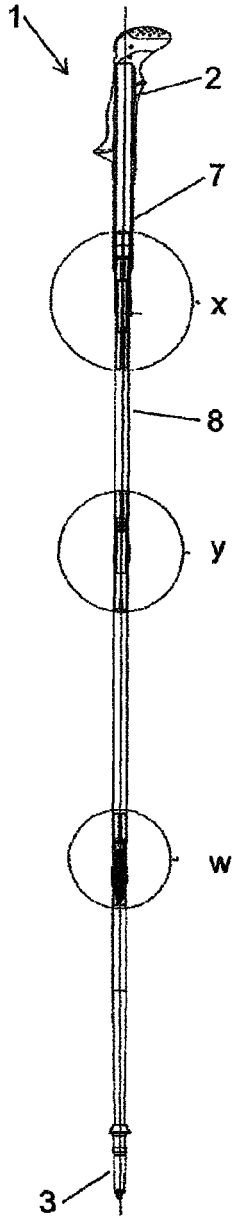
FIG. 1 shows a folding pole from the prior art, FIG. 1*a* showing an axial section through the pole in the assembled state, FIG. 1*b* showing an overall view in the assembled state and FIG. 1*c* showing an axial sectional representation of the plug connection marked in FIG. 1*a* with the reference X.
Figure 1B:
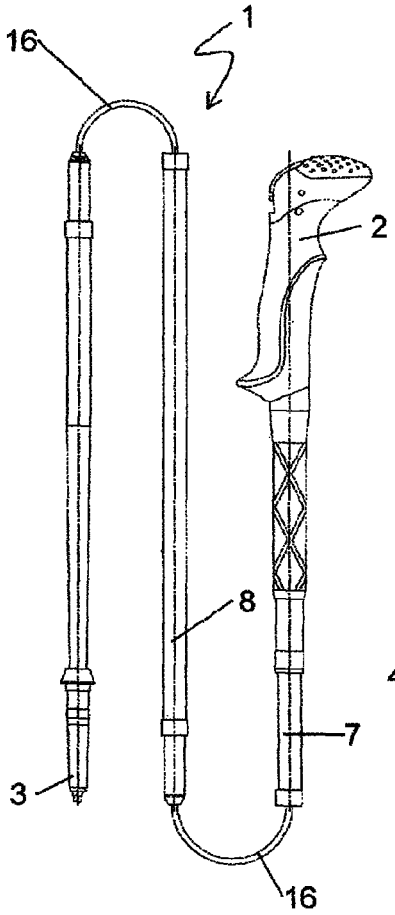
Figure 1C:
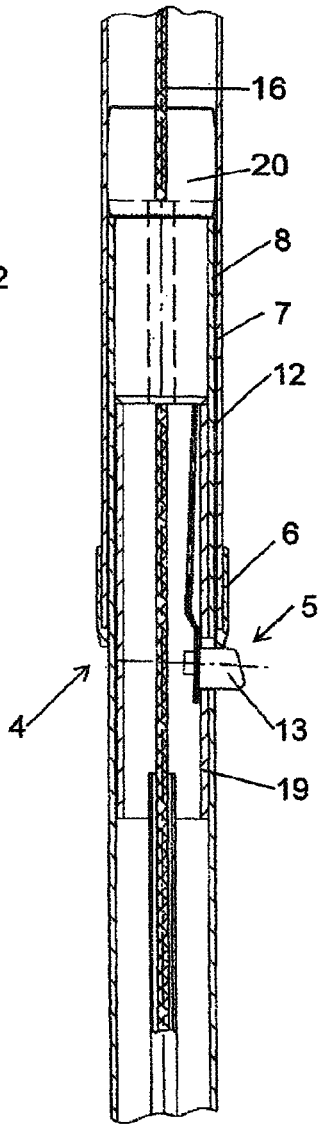

FIGS. 1*a*-1*c* show views of a multi-segmented folding pole according to an embodiment described in WO 2012/104424. Such a pole (1) comprises a pole handle 2 and a pole tip 3 or, as an alternative to this, a pole buffer, with a variable number of tubular portions located in between. Each of the tubular portions can basically be an aluminum or carbon-composite tube. The individual tube portions 7, 8, in this case, are connected together by means of a flexible but stretch-resistant tension cable 16. The tension cable is fastened to the bottommost tubular portion and fastened to the topmost tubular portion and is arranged running through the interior 17 of the at least two central tubular portions. The folding pole shown from the prior art, in this case, is realized such that it is able to be transferred from the folded-together state into the assembled state by the plug connections, which are realized as pure plug connections where tubular portions in the plugged-together state are fixed only in one axial direction, being plugged together, and by, when the latching device 5 is then detached, the second tubular portion 8 being pulled out of the first tubular portion 7 until the tension cable 16 is tensioned, and by the positive-locking latching device 5 being fixed.

In the view of the detail in FIG. 1*c*, the cutout marked in FIG. 1*a* by way of the reference X is shown in detail. In this case, a second tubular section 8 or an inner tube portion, is inserted or plugged into a first tubular portion 7, or the outer tube portion, on the plug connection. So that this is possible, the first tubular portion 7 comprises an inside diameter d7 which is somewhat larger than the outside diameter d8 of the second tubular portion. This difference is certainly only small, but results nevertheless in a space 12, which extends along the overlapping region of the two tubular portions in the direction of the pole longitudinal axis A, being formed between the two tubes. Said space 12 results in the two tubular portions 7, 8 contacting one another in use and leads to an annoying rattling noise.

The second tubular portion 8 comprises a guiding pin 19 which is provided with an axially extending central through-bore for the tension cable 16 and is fixedly fastened with a fastening portion 21 in said second tubular portion 8 and, located opposite axially, comprises a closure pin 20 which is insertable into the first tubular portion 7, a preferably radially circumferential, outwardly directed bearing flange 20*c*, which in the plugged-together state is moved in axial abutment with the tube end of the second tubular portion 8, being provided between the fastening portion 19*a* and a head region 20*a* of the closure pin 20.

A tubular sleeve 6 is additionally arranged in the region of the plug connection 4. At its bottom end, said tubular sleeve directly surrounds the bottom end of the first tubular portion 7 by way of a circumferential flange 10. The latching device 5 is arranged directly below the tubular sleeve, a spring-loaded latching pin 13 engaging in a through-opening 15 of the second tubular portion 8 and of the fastening portion 19*a* of the guiding pin 19.

Figure 2A:
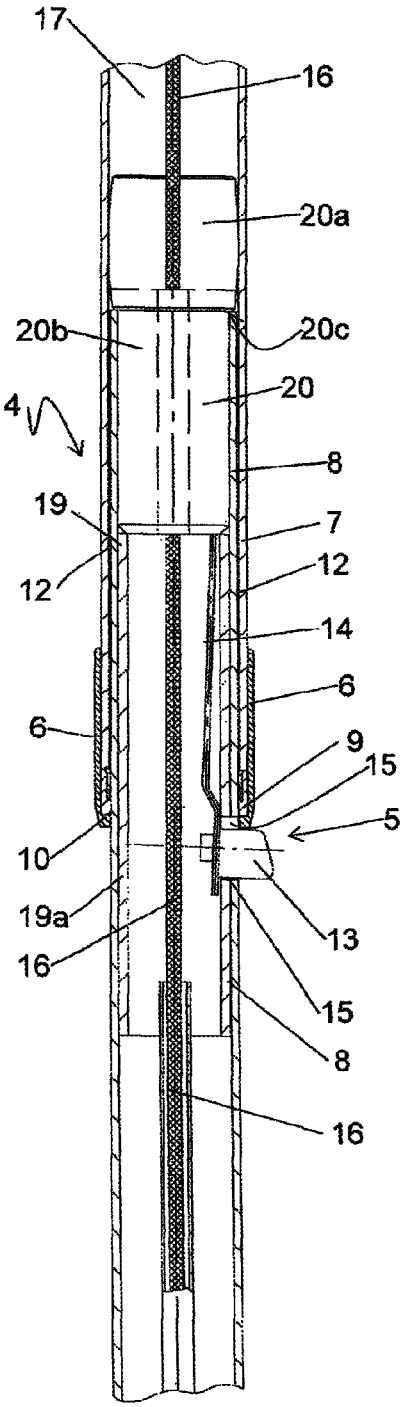
FIG. 2*a* shows an axial sectional representation of a plug connection of a folding pole according to a first preferred embodiment of the present invention.
Figure 2B:
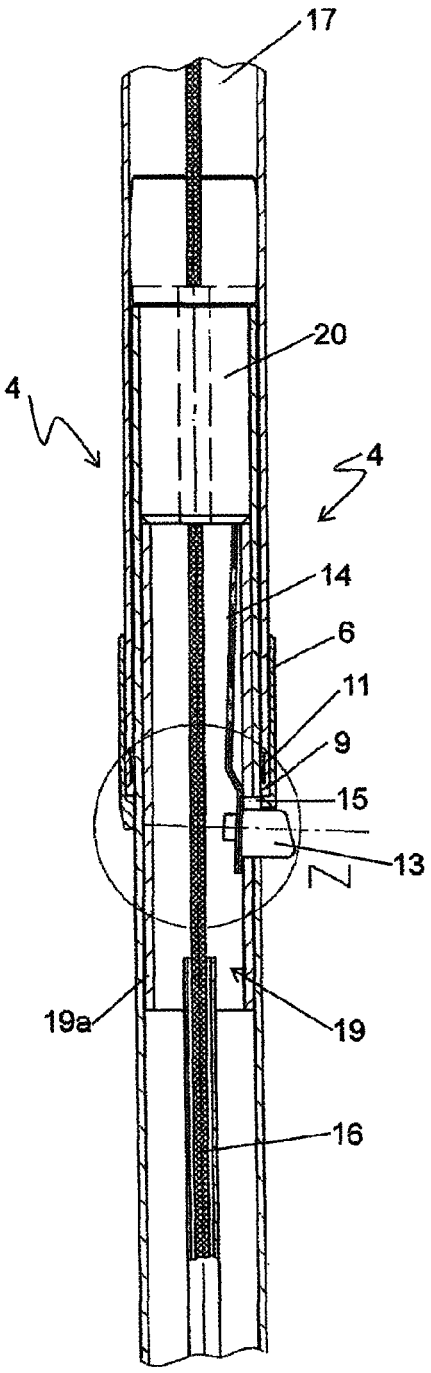
FIG. 2*b* shows an axial sectional representation of a plug connection of a folding pole according to a second preferred embodiment of the present invention.

FIG. 2*a* shows a plug connection 4 in a pole 1 according to a first preferred embodiment of the present invention. The plug connection 4 corresponds substantially to that in FIG. 1*c*, and the afore-described features of a said plug connection are also applicable to said embodiment. The feature relevant to the invention here is that a clamping element 9 is mounted between the radial inside surface of the tubular sleeve 6 and the radial outside surface of the second tubular portion. The tubular sleeve 6 therefore comprises on its bottom end a circumferential flange which, however, in contrast to the prior art according to FIG. 1*c*, does not surround and engage under the bottom end of the first tubular portion 7 directly, but by realizing a circumferential receiving groove 11. Said receiving groove 11 extends in the axial direction, i.e. along the pole longitudinal axis A form the bottom end 21 of the first tubular portion 7 up to the stop on the radial flange 10 of the tubular sleeve, and in the radial direction between a radial inside surface 6*a* of the tubular sleeve up to a radial outside surface 8*b* of the inner tube portion. The width of said receiving groove 11 in the radial direction is substantially the thickness of the first tubular portion 7, or only marginally greater. A clamping element 9 is then arranged in said receiving groove 11. Said clamping element has, among other things, the job of reducing or even avoiding the unwanted rattling noise which is caused by the two tubular portions 7, 8 contacting one another and of eliminating or decreasing all other disadvantages which can result from the play between the elements 7 and 8.

Figure 5:
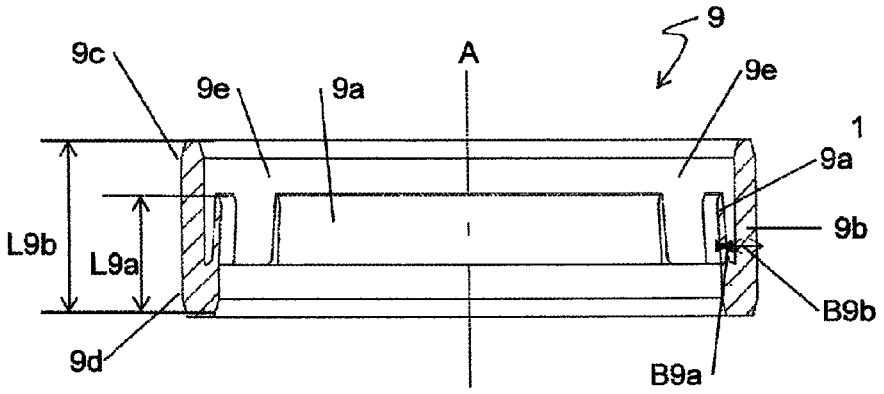
FIG. 5 shows an axial sectional representation through a clamping element according to a first preferred embodiment of the invention.

According to the preferred exemplary embodiment shown in FIG. 5, the clamping element 9 is developed in a substantially ring-shaped manner, the radially outer portion 9*b* of the clamping element 9 which abuts against the radial inside surface 6*a* of the tubular sleeve 6 being realized continuously in the circumferential direction U, whilst the radially inner portion 9*a* of the clamping element 9 which is directed toward the second tubular portion 8 is provided with interruptions 9*e*. The radially inner portion 9*a* of the clamping element 9 to a certain extent resembles a lip which points upward toward the pole tip, said lip being interrupted in the circumferential direction according to FIG. 5. This results to a certain extent in the radially inner portion 9*a* of the clamping element 9 having a toothing.

The axial sectional representation shown in FIG. 5 shows a hook-shaped or U-shaped cross section through the clamping element 9. In this case, the radially inner portion 9*a* is developed in cross section as an inner leg 9*a* with a shorter length L9*a* and wider width B9*a* and the radially outer portion 9*b* as an outer leg 9*b* with a longer length L9*b* and wider width B9*b*, connected by the bottom portion 9*d* which reduces conically or tapers toward its end. The legs 9*a*, 9*b* are both directed upward toward the pole handle 2 and at their top ends are also realized reducing conically or tapered.

Figure 3A:
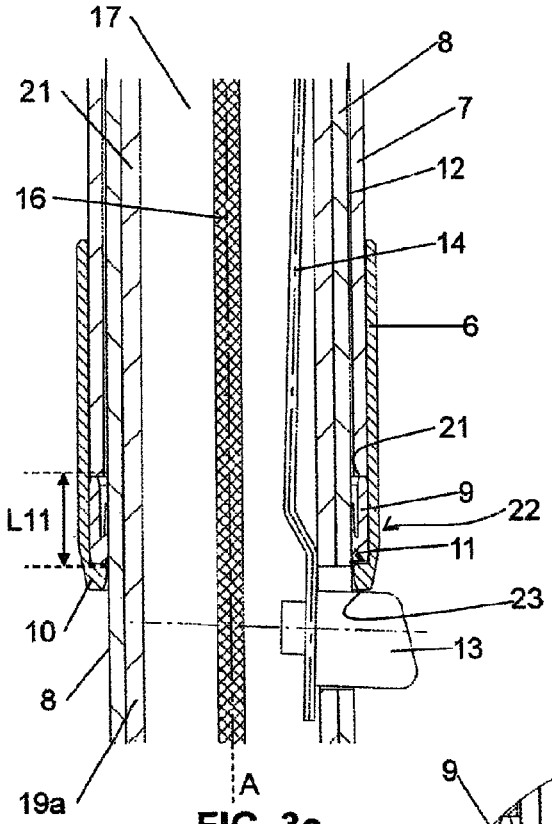
FIG. 3*a* shows a view of a detail of the plug connection from FIG. 2*a;*

As shown in section in FIG. 3*a*, the clamping element 9 in the exemplary embodiment shown fills out the radial width B11 of the groove 11. In the exemplary embodiment shown, the clamping element 9 comprises on its top portion 9*c* and its bottom portion 9*d* a conical tapering, more easily visible in FIG. 5. The axial height L11 of the groove 11 is also filled out substantially by the radially outer portion 9*b* of the clamping element 9. The clamping element 9 consequently seals the groove 11 to a certain extent. However, it also acts as a spacer for the two tubular portions 7, 8 and prevents uncontrolled contact between the two tubular portions 7, 8 when the pole is in use.

When the pole is in use, such a development provides for flexible resilient deforming of the clamping element in the axial and radial direction.

Figure 3B:
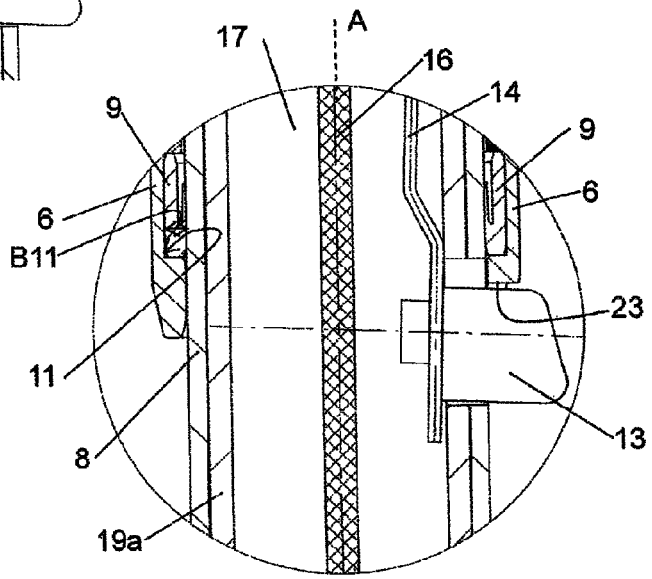
FIG. 3*b* shows a view of a detail of the cutout of the plug connection of FIG. 2*b* marked with the reference Z.
Figure 4A:
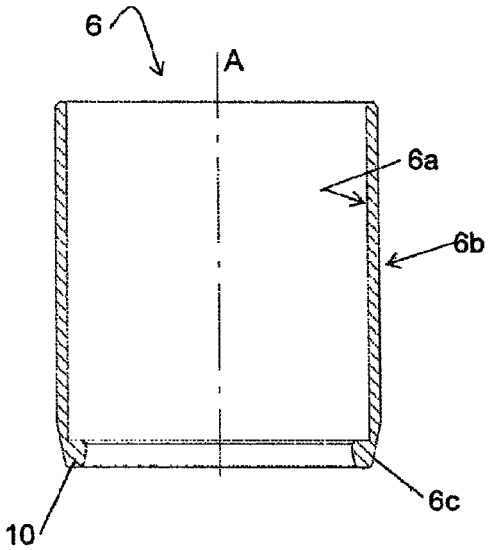
FIG. 4*a* shows a sectional representation of the tubular sleeve of FIG. 2*a* without a clamping element.
Figure 4B:
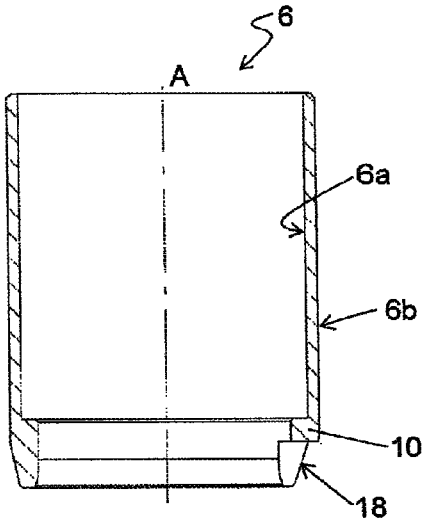
FIG. 4*b* shows a sectional representation of the tubular sleeve of FIG. 2*b* without a clamping element.
Figure 4C:
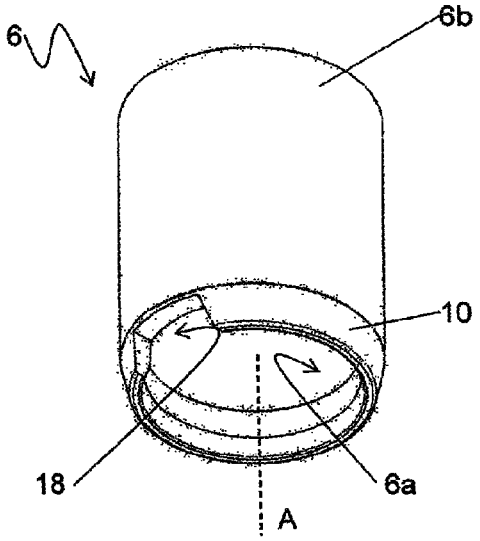
FIG. 4*c* shows a perspective view of the tubular sleeve of FIG. 2*b* or 4*b* without a clamping element.
Figures 6A, 6B:
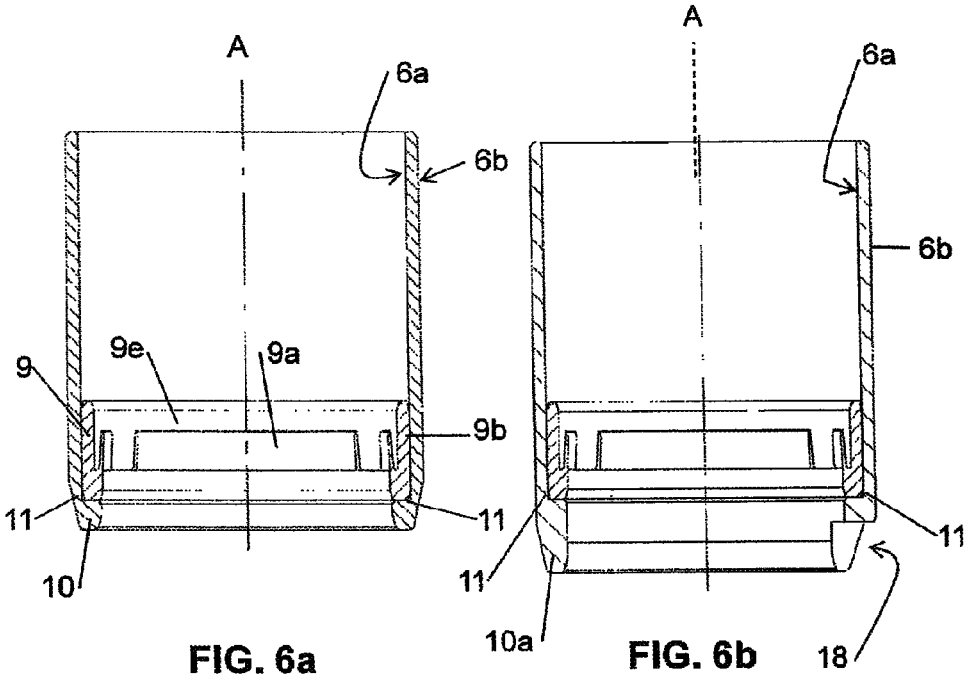
FIG. 6*a* shows an axial sectional representation of the tubular sleeve of FIG. 2*a* with a clamping element.
FIG. 6*b* shows an axial sectional representation of the tubular sleeve of FIG. 2*b* with a clamping element.

In order to prevent the tubular portions 7, 8 rotating relative to one another when in use, and consequently the correct relative rotational position between the pole handle 2 and the pole tip 3 (for example in the case of an asymmetric buffer) not being ensured, an anti-rotation means can be provided. This is realized in the exemplary embodiment in FIGS. 2*b*, 3*b*, 4*b*, 4*c* and 6*b* in a preferred variant. For this purpose, as shown in FIGS. 4*b* and 4*c*, the tubular sleeve 6 comprises a recess 18 in the circumferential direction U which is realized downwardly open here. Said recess 18 is arranged in the region of the flange 10 in the present exemplary embodiment in FIGS. 4*b* and 4*c*. The recess 18 serves for receiving the latching pin 13 which engages through said recess in the radial direction before it protrudes through a through-bore 15 in the second tubular portion 8 and then in the fastening region 19*a* of the guiding pin 19. Consequently, the two tubular portions 7, 8 are secured against rotation with respect to one another. In said exemplary embodiment, the flange 10 of the tubular sleeve 6, which encompasses the bottom end of the first tubular portion, is realized shorter in the region of the recess 18 than in the remaining circumferential region of the tubular sleeve 6, which can be seen well in FIGS. 3*b*, 4*b* and 6*b*.

With the exception of the specific development of the tubular sleeve 6, the remaining above-described features of the pole 1 and of the clamping element 9 are also applicable to the exemplary embodiment with the anti-rotation means.

The invention claimed is:

1. A pole having at least two tubular portions, wherein, in an assembled state of the pole, the tubular portions are connected together by at least one plug connection aligned along a pole longitudinal axis, and wherein a pole handle is arranged on a topmost tubular portion and a pole tip is arranged on a bottommost tubular portion, wherein at least one of the plug connections is formed as a positive-locking and/or non-positive-locking detachable latching device between a first tubular portion and a second tubular portion, the second tubular portion has a smaller or almost identical outside diameter compared to the inside diameter of the first tubular portion and is insertable into the first tubular portion, and the tubular portions are able to be fixed in their relative axial position by the positive-locking and/or non-positive-locking latching device, wherein the plug connection includes a tubular sleeve which is fastened so as to be non-movable on the first tubular portion, protrudes in a protrusion region over an end edge of the first tubular portion facing the second tubular portion, engages under said end edge radially by way of a circumferential flange which is directed to the second tubular portion and surrounds the second tubular portion in the protrusion region, wherein a clamping element is arranged in the protrusion region between a radial inside surface of the tubular sleeve and the radial outside surface of the second tubular portion, wherein a circumferential, inwardly open receiving groove is formed in the protrusion region delimited by the end edge, a radial inside surface of the tubular sleeve and the circumferential flange, wherein the clamping element is arranged in said receiving groove, and wherein the clamping element is dimensioned such that it contacts both the radial inside surface of the tubular sleeve and a radial outside surface of the second tubular portion and clamps said surfaces against one another in a resilient manner.

2. The pole as claimed in claim 1, wherein the tubular sleeve is connected fixedly to the first tubular portion in a non-positive-locking and/or positive-locking and/or materially bonding manner.

3. The pole as claimed in claim 1, wherein the latching device is realized as a positive-locking latching device.

4. The pole as claimed in claim 1, wherein the tubular sleeve is formed substantially from a light metal.

5. The pole as claimed in claim 1, wherein the clamping element is resiliently deformable at least in regions.

6. The pole as claimed in claim 1, wherein the clamping element is realized in a substantially ring-shaped manner, wherein the clamping element completely surrounds the second tubular portion in the circumferential direction.

7. The pole as claimed in claim 1, wherein the clamping element comprises a radially inner portion and a radially outer portion.

8. The pole as claimed in claim 7, wherein the clamping element is realized per se in a resilient manner, or wherein the clamping element is realized with multiple parts or multiple regions, wherein only part or a region is formed from a resiliently deformable material, or wherein the radially inner portion of the clamping element is developed from a material with greater resilient deformability than the radial outer portion of the clamping element.

9. The pole as claimed in claim 7, wherein the clamping element is realized per se in a resilient manner, or wherein the clamping element is realized with multiple parts or multiple regions, wherein only the radially inner portion of the clamping element, is formed from a resiliently deformable material, or wherein the radially inner portion of the clamping element is developed from a material with greater resilient deformability than the radial outer portion of the clamping element.

10. The pole as claimed in claim 1, wherein the clamping element comprises, at least in part of its circumference in a cross section along the pole longitudinal axis, a substantially hook-shaped or U-shaped profile with a radially inner leg and a radially outer leg.

11. The pole as claimed in claim 10, wherein the radially inner portion of the clamping element is provided in the circumferential direction with at least one recess.

12. The pole as claimed in claim 10, wherein the radially inner portion of the clamping element is provided in the circumferential direction with at least one recess which is upwardly open toward the pole handle.

13. The pole as claimed in claim 1, wherein a spring-loaded radial latching pin is held, running through a recess of the tubular sleeve which extends in the circumferential direction, wherein the first and the second tubular portions are held non-rotatably with respect to one another in the circumferential direction.

14. The pole as claimed in claim 1, wherein the pole is a folding pole, wherein the tubular portions are connected together by at least one tension cable.

15. The pole as claimed in claim 1, having at least three or four tubular portions.

16. The pole as claimed in claim 1, wherein the tubular sleeve is connected fixedly to the first tubular portion in a materially-bonding manner, to the bottom end of the first tubular portion facing the pole tip.

17. The pole as claimed in claim 1, wherein the latching device is realized as a positive-locking latching device which comprises a spring-loaded radial latching pin which is held projecting outward in a radial through-bore of the second tubular portion against the action of a spring element, and which additionally protrudes over the radial outside surface of the second tubular portion with the plug connection latched in position and is in abutment with the axial closure surface of the flange facing the second tubular portion.

18. The pole as claimed in claim 1, wherein the tubular sleeve is formed substantially from a light metal, selected from aluminum or an aluminum alloy.

19. The pole as claimed in claim 1, wherein the clamping element is resiliently deformable at least in regions, wherein the clamping element is formed at least in part from plastics material, selected from a thermoplastic material or a thermoplastic elastomer.

20. The pole as claimed in claim 19, wherein the clamping element is formed at least in part from cross-linked or non-cross-linked systems based on polypropylene, polyethylene, polyester, polyamide, copolyamide, thermoplastic olefin-based and/or urethane-based elastomers, thermoplastic polyester elastomers, thermoplastic copolyester or a mixture thereof.

21. The pole as claimed in claim 1, wherein the clamping element is realized in a substantially ring-shaped manner, wherein the clamping element completely surrounds the second tubular portion in the circumferential direction, and is realized in one part, wherein it additionally fills out the axial length of the receiving groove substantially completely or at least in regions.

22. The pole as claimed in claim 1, wherein the clamping element comprises a radially inner portion and a radially outer portion, wherein the radially outer portion fills out the axial length of the receiving groove substantially completely and wherein the radially inner portion comprises a shorter axial length than the axial length of the receiving groove.

23. The pole as claimed in claim 1, wherein the clamping element comprises, at least in part of its circumference in a cross section along the pole longitudinal axis, a substantially hook-shaped or U-shaped profile with a radially inner leg and a radially outer leg of various lengths, and also of various maximum widths measured in the radial direction, wherein the outer leg, at least in regions, fills out the axial length of the receiving groove substantially completely, and additionally the radially inner leg has a shorter axial length than the radially outer leg and a narrower radially measured maximum width than the radially outer leg, wherein, with the clamping element arranged in the receiving groove, the two legs, compared to a rest position at a first angle between the legs, are pressed against one another to form a second smaller angle between the legs.

24. The pole as claimed in claim 1, wherein a spring-loaded radial latching pin is held, running through a recess of the tubular sleeve which extends in the circumferential direction and is realized open toward an end of the tubular sleeve facing the pole tip, wherein the first and the second tubular portions are held non-rotatably with respect to one another in the circumferential direction.

25. The pole as claimed in claim 1, wherein the pole is a folding pole, wherein the tubular portions are connected together by at least one tension cable, wherein at least two tubular portions are connected together in a folded-together state of the folding pole only by the tension cable.

* * * * *